US006203164B1

(12) United States Patent
Tufekci et al.

(10) Patent No.: US 6,203,164 B1
(45) Date of Patent: Mar. 20, 2001

(54) NIGHTTIME TOILET SEAT POSITION INDICATOR

(76) Inventors: Suleyman Tufekci, 4000 NW. 51st. St., Apt. 115, Gainesville, FL (US) 32606; Nathaniel Cameron, 2603 NW. 13th St., Gainesville, FL (US) 32609

( * ) Notice: Subject to any disclaimer, the term of this patent is extended or adjusted under 35 U.S.C. 154(b) by 0 days.

(21) Appl. No.: 09/140,604

(22) Filed: Aug. 26, 1998

(51) Int. Cl.[7] ..... F21V 33/00

(52) U.S. Cl. ..... 362/101; 362/154; 362/276; 362/802; 4/661

(58) Field of Search ..... 362/101, 154, 362/155, 276, 802, 395; 4/661

(56) References Cited

U.S. PATENT DOCUMENTS

| | | | | |
|---|---|---|---|---|
| 4,413,364 | * | 11/1983 | Bittaker et al. | 362/802 |
| 4,491,991 | * | 1/1985 | Herbruck | 4/661 |
| 4,733,419 | * | 3/1988 | Nee | 4/661 |
| 4,736,471 | * | 4/1988 | Johnson | 4/661 |
| 4,860,178 | * | 8/1989 | Picon | 362/101 |
| 5,003,648 | * | 4/1991 | Anderson | 4/661 |
| 5,150,962 | * | 9/1992 | Rauschenberger | 362/101 |
| 5,664,867 | * | 9/1997 | Martin et al. | 362/101 |

* cited by examiner

*Primary Examiner*—Thomas M. Sember

(57) ABSTRACT

A device to detect the position of the toilet seat and alert the user by means of a visual signal. It consists of housing mounted on the underside of a toilet seat cover (3). The housing encloses a light source (4), the circuit (5) and power source (11) required to energize the source and a mechanically operated sensor device (7), which detects the position of the seat If the seat is up, the sensor device detects the position of the seat whereby sending the appropriate signal through the electronic circuitry to gently illuminate the seat cover with the light source (FIG. 2). The device has the built-in feature, which prevents it to activate the light source when both seat and cover are in horizontal down position, thereby conserving the power in the batteries which are used as the power source (FIG. 3). The device is designed in such a way that it provides no signal to the potential user of the toilet when the seat is down, whereby avoiding unnecessary light to further awaken a drowsy user in the middle of the night. Thus the invention provides a female friendly functionality, in which, it does not disturb the female user with unnecessary signal when not needed. In addition, the device also helps training the male users to bringing the seat down after using the toilet since during the urination by a male user, the light signal will be on to warn him to lower the seat after the use of the toilet is completed. In addition, the device has the built in feature that makes the device inactive during daytime operation through its unique swinging arm (7) design (FIG. 4) even when the seat and the seat cover are in up position.

5 Claims, 5 Drawing Sheets

NIGHTTIME TOILET SEAT POSITION INDICATOR

BACKGROUND

1. Field of Invention

This invention relates to a lighting means and, in particular, nighttime lighting means for a toilet to indicate the position of the toilet seat.

2. Description of Prior Art

Previous inventors have proposed numerous light signaling devices for the toilet area addressing the problem of warning people of the position of the toilet seat at nighttime. However, there are numerous disadvantages to the prior art as discussed below.

Patrie of U.S. Pat. No. 5,276,595 discloses a lighting means for the toilet area, which is energized when a person approaches to the vicinity of the toilet seat. According to the position of the toilet seat, the devises illuminates the toilet seat area with green lighting if the seat is down and with a red lighting and a brief chime sound if the seat is in up position.

Unfortunately, the device turns on even when the intent of the visitor of the bathroom is not to use the toilet when the human sensor senses the presence of a human being. It is even possible that a large house pet might also trigger the device. Furthermore, if the toilet seat is directly under the heating duct outlet, it may get turned on every time the heater blows hot air directly onto the device. The human sensing is performed via the infrared proximity sensor, which is sensitive to temperature changes near the device. Therefore, the device will turn itself on even in its shipment box, if the box is held in hand for a few seconds. This situation thereby will drain the batteries, which are the power source for the device before the device reaches the consumer's hands. In addition, many female users who are in need of using the bathroom in the middle of night by interrupting their sleep, are in a drowsy and semi sleeping state and wish to return to bed with minimal disturbance after relieving themselves. Even a small light source will have the awakening effect on the user. Therefore, illumination of the toilet seat when not needed by the female user, this device disturbs the semi-sleeping state, even if the toilet seat is in the correct position, thereby making the female user more awake. And hence, this unnecessary light and sound signal further contributes to the disruption of a good night sleep and mental relaxation of the female user. This, in turn, will have a negative effect on the female users daily activities and mental health. Furthermore, this design uses an infrared proximity sensor for detecting the presence of humans, a light sensor for detecting the darkness in the bathroom, and a sonar sensor for detecting the position of the toilet seat. Operating all these sensors require the use of a complex electronic circuitry with many capacitors, resistors and microprocessors which are very prone to humidity and acidic environment which is generally found around toilet seat area. Failure of any one of these electronic components may render the device inoperable. Reliability of any electronic device is inversely proportional to the number of electronic components included in the circuitry. Having so many sensitive electronic components makes this device vulnerable for malfunction in the adverse environmental condition it is intended to operate. Furthermore, the device will not work, as intended, in toilets where the front of the toilet seat is deliberately eliminated for accommodating male users. Because, there will be no object directly above the device to activate the proximity sensors, which activate the light and audio signals for correctly identifying the position of the seat Martin, et. al. of U.S. Pat. No. 5,664,867, Warrington of U.S. Pat No. 4,849,742, Johnson of U.S. Pat. No. 4,736,471 and Herbruck of U.S. Pat. No. 4,491,991 all disclose lighting means, which detect the position of the toilet seat by using gravity-activated switch mechanisms. A mercury switch is used in activating the circuitry when the seat is in up position and deactivating the circuitry when the seat is in down position. The dangers of the mercury to human health and environment make these devices undesirable. Malfunction and seepage of mercury into the bathroom, into the sewer system, and onto human hands and body may cause permanent damage to human brain function and the nervous system. Martin's and Warrington's inventions must be affixed to the bottom of the toilet seat thereby making it hygenically undesirable since the device is very close to the rim of toilet bowl which is usually the least clean area of the bowl. Furthermore, if the seat is in the up position even in daytime, the mercury switch activates the light source, thereby consuming the power supply rapidly when not needed Herbruck's device requires the user to be seated on the toilet for the deactivation of the light and sound source. The back of the individual pusher against a pivoted plate which in turn deactivates the device. Such a plate touching the body may be uncomfortable for the user. Furthermore, if the user leans forward on the seat, the plate may lose contact with his body and set off the alarm. Bittaker et. al. of U.S. Pat. No. 4,413,364, Nee of U.S. Pat. No. 4,733,419, Picon of U.S. Pat. No. 4,860,178, Anderson of U.S. Pat. No. 5,003,648, Rauschenberger of U.S. Pat. No. 5,150,962 all disclose lights for the toilet area, which are de-energized when the toilet seat is in the down position. Unfortunately, each invention require the seat to be stored in the down position to deenergize the light, whereas many people prefer to keep the seat in the up position particularly in the daytime. Furthermore, Anderson's, Rauschenberger's and Nee's inventions attach to the rim of the toilet thereby making it unsanitary as male uses will soil the rim of the toilet on many occasions. Anderson's design will need excessive amount of plastic material to manufacture the flange, which covers almost two-thirds of the rim making the product costly. In addition, the housing, which includes the switch and the batteries, being placed in close proximity to the toilet bowl, may get soiled with urine during routine use of the toilet. It will then require frequent washing and sanitation thereby requiring the housing to be water-tight which will also increase the manufacturing cost of the product. Possible fluid leakage into the housing will rust the battery terminals and electrical components of the product thereby reducing the product life.

Pican's invention requires the L-shaped body to be attached to the bottom of the toilet seat. When the seat is in down position the switch is depressed and therefore no light is emitted by the light source. When the seat is raised the switch would not be depressed and thus the spring mechanism would cause the switch to contact thereby causing the illumination of light means. An additional manual toggle switch, in parallel, permits the operator to activate or deactivate the circuit when the seat is in down position. This invention is also placed under the seat, which is the most unsanitized portion of the toilet area. The invention attaches to the bottom of the toilet seat which faces the top of the toilet rim thereby making it unsanitary as male users will soil the rim of the toilet on many occasions. Furthermore, the light portion of the L-shaped design extends into the toilet bowl thereby will get stained by splash of water, urine and human feces during the flushing of the toilet. It will then require washing and sanitation frequently thereby requiring the housing to be water-tight which will also increase the manufacturing cost of the product. Since the L-shaped assembly is adhesed to the bottom side of the toilet seat, removal of it for sanitation purposes will be almost impossible. In the case of forced removal, a new adhesion will be necessary to readhese the assembly under the seat thereby making it impractical and costly since each time a new adhesive strip needs to be used.

All previous inventions, which are attached to the underside of the toilet seat are unsanitary and create health problem if kept unclean. Cleaning and reattaching them to their original position becomes an arduous, if not an impossible task. All previous inventions, which use gravity activated mercury switches, potentially may cause significant human and environmental health problems. As the products are disposed to trash collection yards, the mercury that will leak from those switches will seep into the ground and pollute the groundwater supplies and create health problems for human beings. An accidental leakage of the mercury from those switches at home will produce mercury vapor, which is known to be very harmful for adults and children.

Objects and Advantages

Accordingly, a principal object of the invention is to overcome the many disadvantages of the aforementioned prior art by providing a toilet light that detects the position of the toilet seat and provides a gentle colored lighting of the toilet area to indicate the up position of the toilet seat, so that people without their corrective eyewear and people who are drowsy in a semi-sleep state can recognize that the toilet seat is in up position, without any confusion.

Another object of the invention is to provide a toilet seat position indicator illuminating the toilet seat area only when the seat is in up position, thereby minimizing the awakening effects of unnecessary light on female users when the seat is in the down position.

Another object of the invention is to provide a toilet light that can be conveniently attached to and detached from an existing toilet and incorporated into a new toilet.

Another object of the invention is to provide a light signal correctly for various toilet seat designs, regardless of the gap between the cover and the seat of the toilet, through a unique geometric design of the mechanical seat position sensor.

Another object of the invention is to provide a toilet light, which eliminates unnecessary power consumption by not lighting up when the seat is in down position.

Another object of the invention is to provide a toilet light, which can be turned off in daytime, at the user's discretion, even when the toilet seat is in up position, through a unique geometric design of the mechanical seat position sensor which can easily be placed in an inactive position by the user, thereby providing a longer battery life.

Further object and advantages will become apparent firm a consideration of the ensuing description and the accompanying drawings.

DRAWING FIGURES

REFERENCE NUMERALS IN DRAWINGS

Figure 1A:
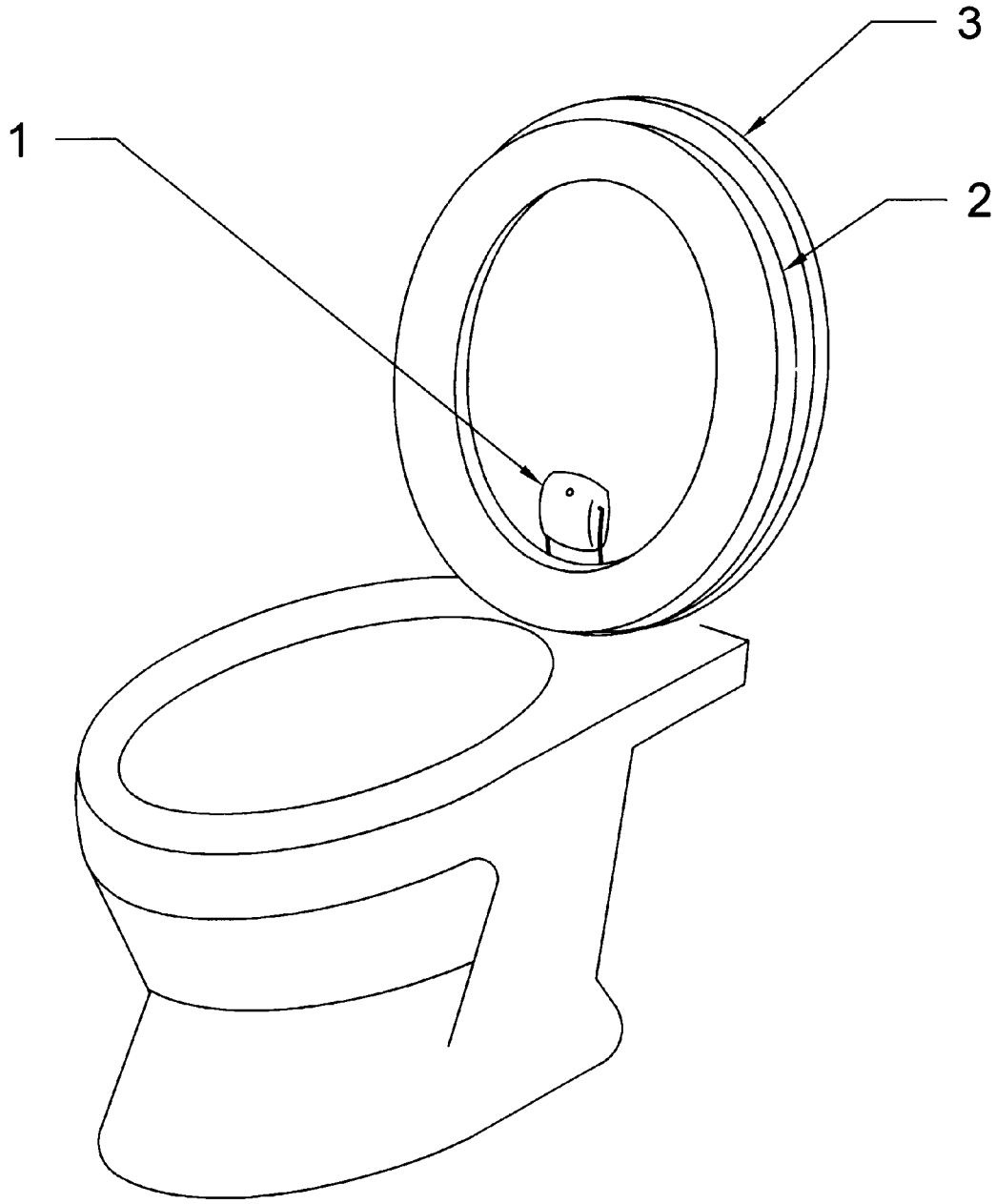
FIG. 1A is a view of the present invention on a toilet

1. Invention
2. Toilet seat
3. Toilet seat cover
4. Housing
5. Circuit board
6. Switch
7. Swinging arm
8. Lamp
9. Housing base
10. Adhesive strip
11. Power source
12. Resistor

SUMMARY

In accordance with the present invention a lighting means and, in particular, nighttime lighting means for a toilet to indicate the position of the toilet seat comprises a housing and means of attaching the housing to said cover such that said housing is approximately framed by the opening in said seat when the seat and the cover are in the up position, a light source, a control device for said light source, a sensing device for activation of said control device, and a source for electrical current.

Descripton—FIGS. 1 to 5

Figure 1B:
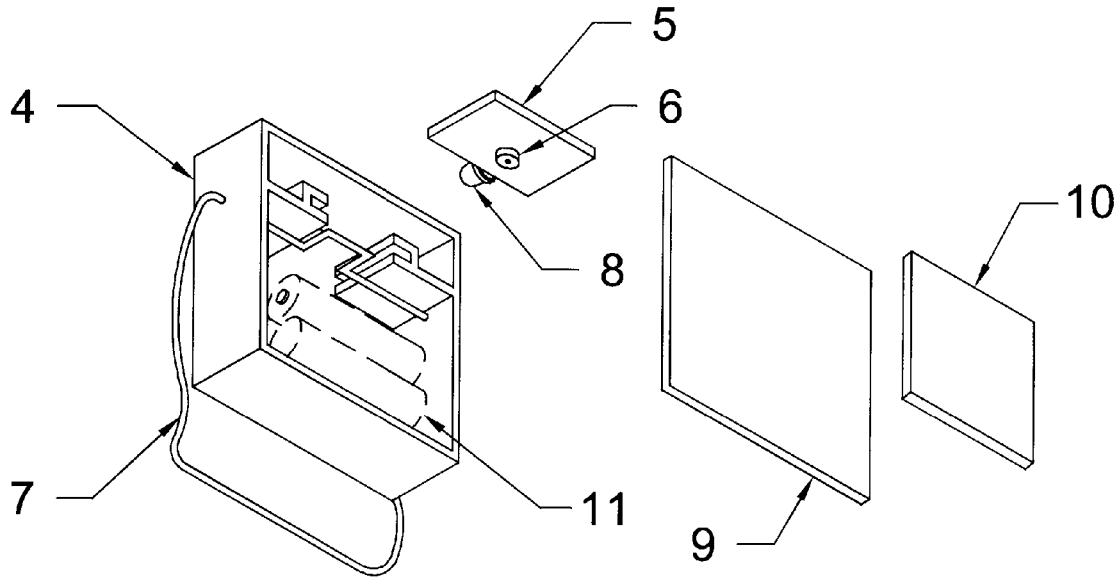
FIG. 1B is an exploded view of the invention.

FIG. 1—Exploded View of the Invention

FIG. 1 shows an exploded view of the preferred embodiment of the invention 1 comprised of a housing 4, an electrical circuit 5, a swinging arm 7, and a housing base 10.

The housing 4 has two holes on the sides and one in the front. The lamp 8 peers out through the hole in the front. This lamp serves as the seat-up indicator light. Light Emitting Diodes (LEDs) are preferable because of their low power consumption and availability of various colors. Certain types of blinking LEDs reduce the power consumption still further, increasing the battery life. Another advantage of LEDs is that the brightness can be easily controlled by the introduction of a resistor in the circuit.

The circuit is located in a printed-circuit-board 5. It holds the lamp, switch and a resistor. The board is fixed to two grooves on the housing.

The arm 7 is assembled in such a way that part of it hangs outside the housing. The arm 7 is pivoted through the side holes and freely rotates about the said holes. The portion of the arm inside the housing is bent in the middle in such a manner as to activate the switch 6. The switch controls the lamp. Hence the lamp can be switched on and off by moving the arm. The arm 7 together with the switch 6 forms the sensor device for detecting the position of the toilet seat. The operation of the sensor is detailed later.

The housing also holds the batteries 11, which are connected to the electrical circuit board by wires.

Figure 2:
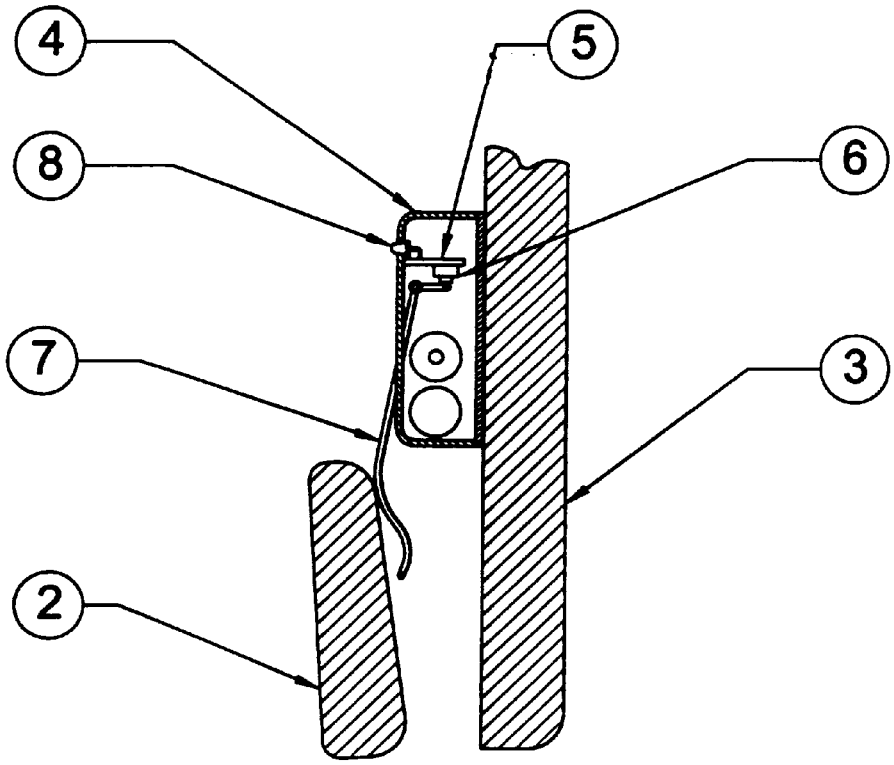
FIG. 2 is a side view of the invention installed on a typical toilet when the seat is up.

FIG. 2. Mounting Detail and Sensor Operation

FIG. 2 shows the side view of the invention attached to the under side of the toilet seat cover 3. The invention is so positioned on the cover that when the seat is brought up to its vertical position, which will be referred to as "the up position," it touches the arm alone. When the seat is in up position the invention is framed within the central opening of the seat, this opening henceforth will be called "the opening." When the seat is brought to rest on the toilet bowl in horizontal position, this position will be referred to as "the down position." Any position of the seat between its up position and down position will be referred to as the "degree of tilt." The mounting is done using adhesive strips or Velcro 10, The figure shows the position of the seat 2 when it just touches the arm 7. Any more upward motion of the seat will cause the arm to depress the switch and turn on the lamp. The user is thus alerted to the up-position of the seat.

Figure 3:
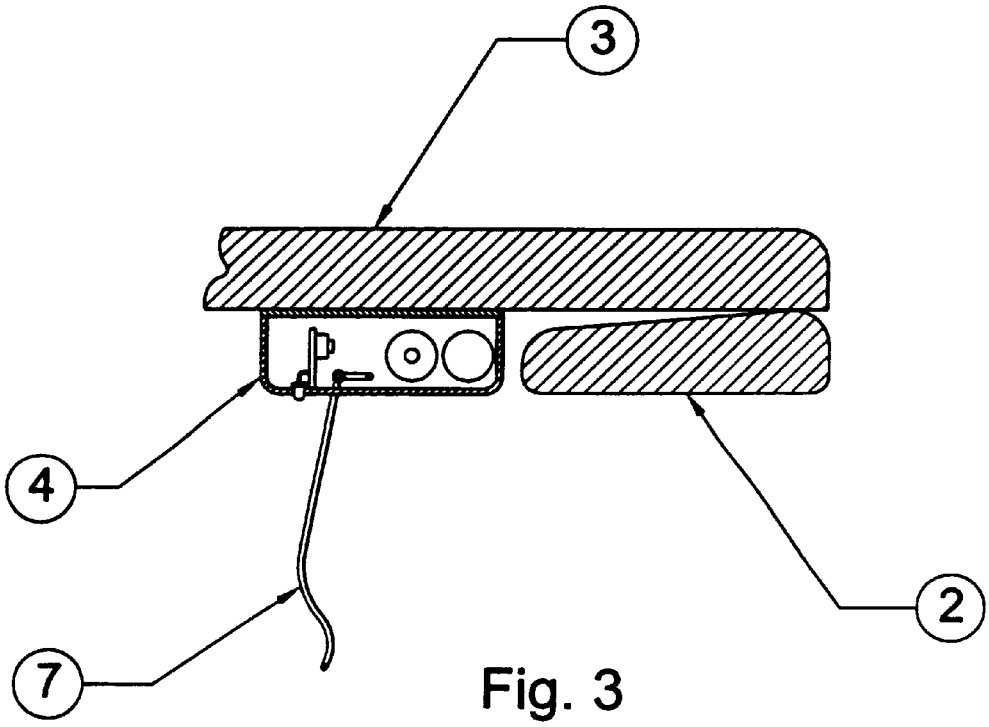
FIG. 3 shows the side view of the invention with the cover closed.

FIG. 3. Sensor Deactivation in the Horizontal Position

FIG. 3 details the invention with the seat and cover in the down position, when both are horizontal. As mentioned earlier, the arm 7 is freely pivoted to the housing. The bent-shape of the arm has two purposes: The lower curve is designed to clear the am from the seat 2 when the cover 3 is being brought down. This curve tends to swing the arm away from the seat thus directing it towards and into the toilet bowl. This allows it to hang vertically when the whole unit is horizontal. This position is depicted in this figure. The switch is not depressed in this position, thus saving battery life when the toilet is not in use.

The upper curve of the arm is designed to suit various sizes of toilet seats. The gap between the seat and the cover may be varied for different makes of toilets. During installation of the invention, both the cover and the seat are kept in the upright position. The unit is then slid downward on the underside of the toilet cover, with the arm going between the seat and the cover. As it is moved further down, the curve in the arm touches the seat. The arm in turn will activate the switch. The Invention is then affixed at this position. The distance of downward motion, or in other words how far the arm should go between the seat and cover, depends on the aforementioned gap. Thus the invention can accommodate any design of toilet.

Figure 4:
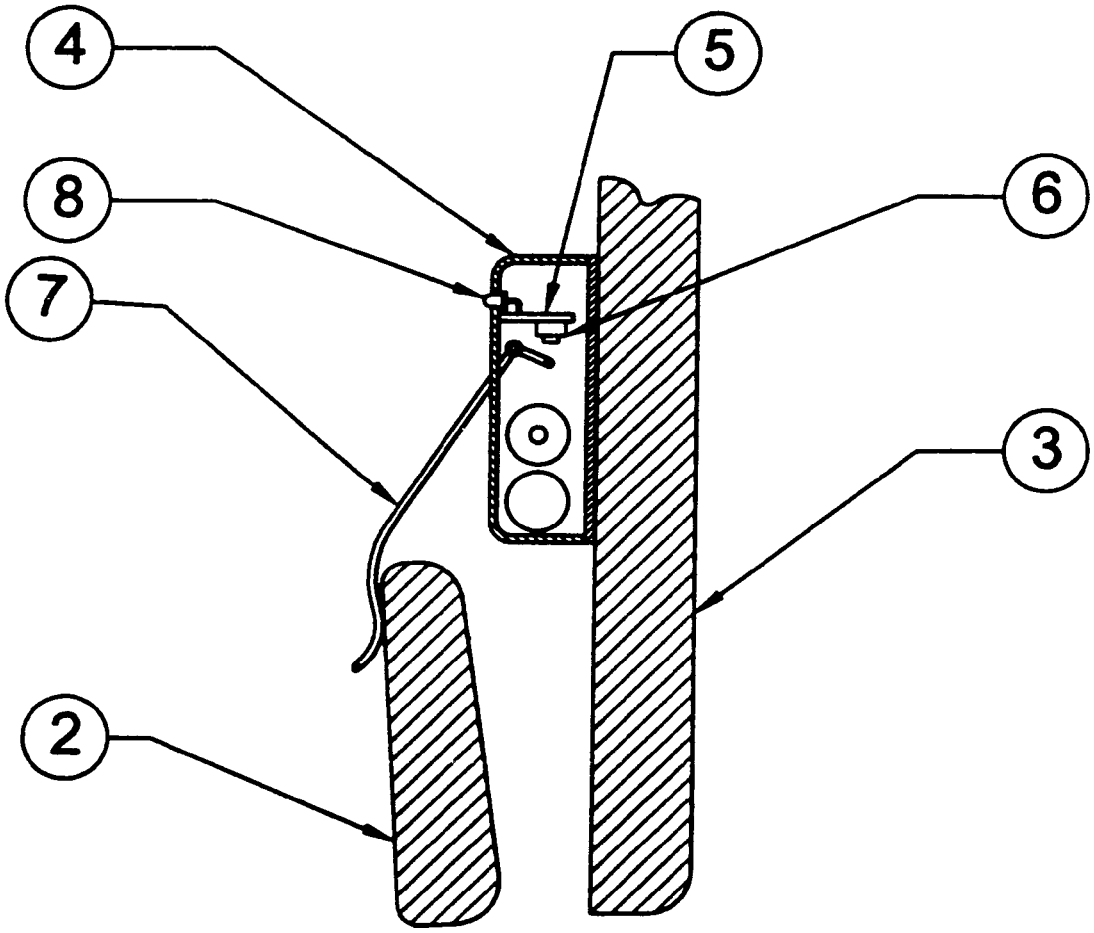
FIG. 4 shows the side view of the invention when the seat is up and the sensor deactivated.

FIG. 4. Sensor De-activation in the Vertical Position

Normally when the seat is lifted up, the sensor is activated as shown in FIG. 2. If the user leaves the seat in the up position for a long time, the light source will continue to drain power from the batteries, which is undesirable. If the user so wishes, he can deactivate the sensing device even in the vertical position. The user simply has to lift the arm 7 over the toilet seat, so that that the arm is no longer depressing the switch 6. This position is shown in FIG. 4. This feature is especially useful during daytime, when some people may prefer to keep the cover and the seat in the up position.

Figure 5:
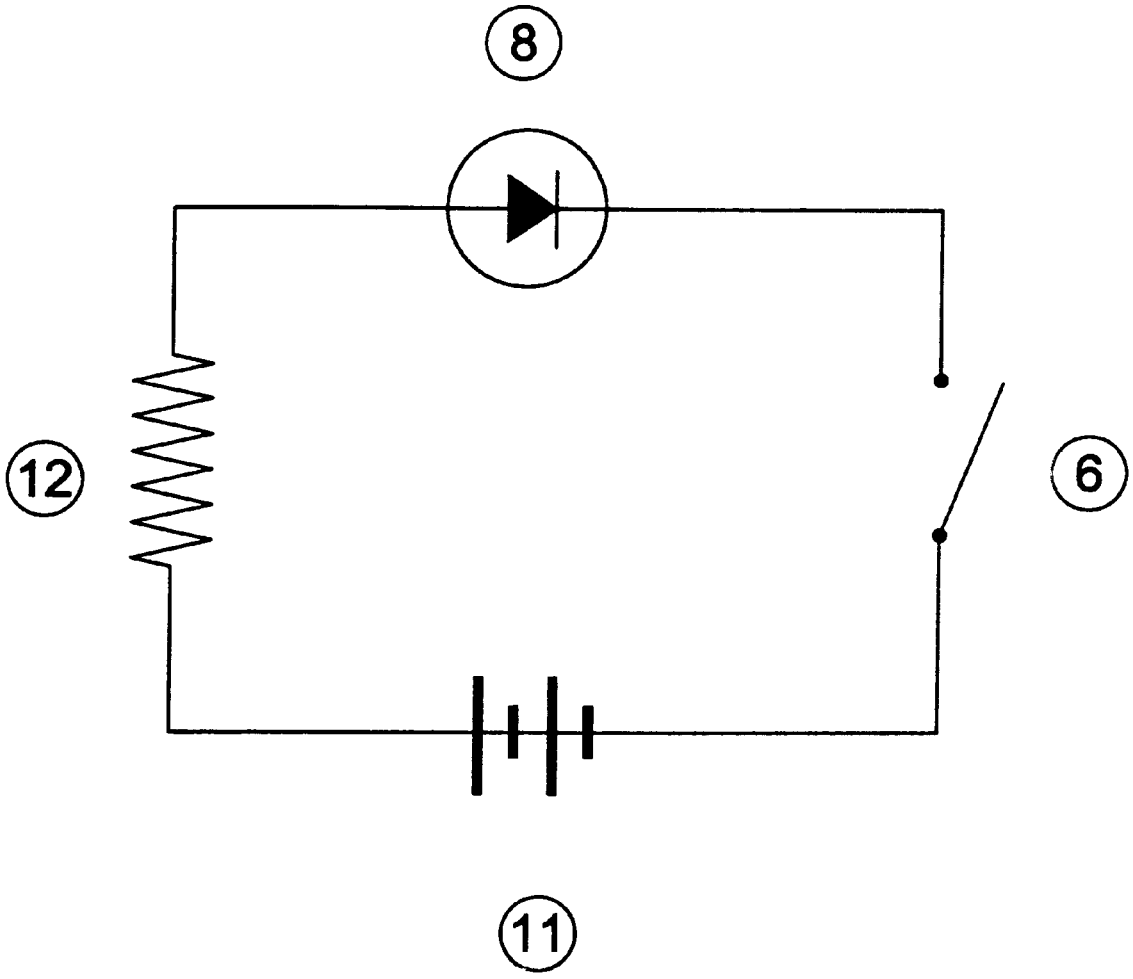
FIG. 5 is an electrical schematic of the invention

FIG. 5 Electrical Schematic of the Invention

FIG. 5 is the schematic diagram of the electrical circuit. The resistor 12 is provided to control the current flow through the lamp so as to increase the battery life. The rest of the circuit is self-explanatory.

SUMMARY, RAMIFICATIONS, AND SCOPE

The toilet light assembly described herein unmistakably warns the user when the seat in the up position. Whereas people not wearing their corrective eyewear at night and people who are drowsy may mistake the position of the toilet seat even in the presence of a nightlight in the bathroom area. The colored LED light of said device shining directly or indirectly at the toilet bowl area warns the user that the seat is in up position. In addition, the passive behavior (no light signal when the seat is down) of the toilet light assembly makes this invention a female-friendly device, which warns the female users only when the seat is in up position, therefore not disturbing them in their drowsy state if the seal is in down position. In addition, the device may be deactivated during daytime or when the bathroom lights are on by simply putting said swing arm of the invention over the toilet seat thereby increasing the battery life. Furthermore, the device, through its unique swing arm design, turns the light source off when both the seat and the cover are in the horizontal position, thereby increasing the battery life which powers the electric circuit. The illumination of the toilet seat area when the seat is in up position also helps the male users of the toilet in two ways. First, it helps by providing a comfortable lighting for standing urination, and secondly, it serves as a reminder to the male users to bring the seat down before they leave the toilet area.

While several specific embodiments of the colored toilet light assembly have been discussed, other variations in the construction and placement of the invention can be made to provide equivalent inventions. There will be other changes, modifications and substitutions, which are considered to be within the scope of the present invention, as set forth in the appended claims. Therefore, the scope of the invention should be determined by the appended claims and their legal equivalents, and not by the examples given.

We claim:

1. In combination with a toilet, said toilet having a bowl, said toilet having a seat, said seat having a central opening, said toilet having a cover, said cover and said seat being pivotable between a down position and an up position, said down position preventing access into said bowl, said up position permitting access into said bowl, a light assembly comprising:

(a) a housing and means of attaching said housing to said cover such that said housing is approximately framed by the opening in said seat when said seat and said cover are in the up position, (b) a circuit mounted on said housing, (c) a light source, mounted on said circuit, (d) a control device for said light source mounted on said circuit, (e) a sensing device for action of said control device, said sensing device being pivotably mounted to said housing, (f) a source for electrical current, said source providing electrical power to energize said light source, whereby, the sensing device when contacted by said seat in the up position activates said control device which allows said light source to be energized by said electric current source through said circuit.

2. The light assembly of claim 1 wherein said sensing device contains means for causing it to stop energizing said light source when said seat is not in the up position.

3. The light assembly of claim 2 wherein said sensing device is a hinged arm with a plurality of curves, said curves permitting said light assembly to function properly in multitude of different toilet designs.

4. The light assembly of claim 2 wherein said sensing device is a hinged arm pivoted only on one side of said housing through a single hole on the side.

5. The light assembly of claim 1 wherein said light source has means for changing colors on actuation of said control device.

* * * * *